United States Patent [19]

Lehner et al.

[11] 4,132,425

[45] Jan. 2, 1979

[54] MULTI-WHEEL IN-LINE ROLLER SKATES

[75] Inventors: Aladar Lehner; Istvan Varga, both of Budapest, Hungary

[73] Assignee: Duoroll A.G., Zug, Switzerland

[21] Appl. No.: 700,347

[22] Filed: Jun. 28, 1976

[30] Foreign Application Priority Data

Jun. 27, 1975 [HU] Hungary ..... LE 774

[51] Int. Cl.[2] ..... A63C 17/02

[52] U.S. Cl. ..... 280/11.23

[58] Field of Search ..... 280/11.23, 11.28, 11.25, 280/11.19

[56] References Cited

U.S. PATENT DOCUMENTS 2,204,280 6/1940 Meister ..... 280/11.23

3,484,116 12/1969 Allen ..... 280/11.21

3,862,763 1/1975 Wars ..... 280/11.28

FOREIGN PATENT DOCUMENTS 959743 9/1947 France ..... 280/11.1

*Primary Examiner*—Joseph F. Peters, Jr.

*Assistant Examiner*—Gene A. Church

*Attorney, Agent, or Firm*—Young & Thompson

[57] ABSTRACT

A two wheel roller skate with at least one steerable wheel (4) mounted on a yoke (5) which is pivotally connected to a steering element (6) mounted on the frame (1) of the skate to pivot about a tilting axis. The yoke (5) is also pivotally connected to the frame (1) by a joint (14). The steering axis (11) of the wheel (4) is preferably perpendicular to the ground and the angle alpha between the tilting axis and the ground is less than 90°.

7 Claims, 10 Drawing Figures

MULTI-WHEEL IN-LINE ROLLER SKATES

This invention relates to a multi-wheel in-line roller skate, having at least one steerable wheel mounted in a wheel bearing, and a main frame which can be inclined laterally about the line connecting the base points of the two or more wheels, i.e., the ground surface. The term 'roller skate' is to be understood here in its widest sense, and in particular as a plaything and/or sports toy which can be attached to the user's foot and is provided with two or more wheels. The term "in-line" means that the wheels are positioned in line front to rear, with only one wheel at each wheel axle.

Among the devotees of roller skating it has always been an aim worth striving for to simulate the many and varied movements of ice skating as faithfully as possible. It is well known that the ice skate has slight frictional resistance in the direction if its longitudinal axis but considerable frictional resistance at right angles thereto, i.e., in a lateral direction, since the ground edge of its blade scores the ice and thereby produces great resistance. The user can therefore move off well, and by altering his foot posture keep well to the curve connected with the spatial position of his centre of gravity. In order that a roller skate can imitate the complicated forms of movement of the ice skate satisfactorily, it has to display the said great lateral friction which, however, should not influence steering of the wheels, since the pivoting of the wheel should only be caused by inclining the foot and shifting the user's weight. This cannot, however, be obtained with existing roller skates.

Among well known steerable roller skates the four-wheel types are the most widespread. The stability provided by the four wheels is seemingly advantageous but becomes a drawback when the user wishes to use the four-wheel roller skate as a summer supplementary or training appliance for the ice skate, since with known four wheel appliances the many and varied movements involved for example in an ice hockey game are not feasible. In the four-wheeled roller skate between the frame and the wheel axle there are installed a non-vertical pin and a rubber pedestal, the parts being pivotable in relation to one another round the pin, so that the tilting of the frame causes pivoting of the wheel. Wheel slewing also occurs, however, in unwanted cases as the laterally directed frictional force produces a torque acting on the steerable wheel which is proportional to the distance from the said oblique pin. To eliminate this drawback, roller skates have been designed with two, three, four or more wheels arranged in a row, which are either attached rigidly and unsteerably, and therefore clumsy in the event of changes of direction, or are made steerable.

The pivoting of the wheel takes place either about a vertical axis (as for instance according to U.S. Pat. No. 3,484,116), the steering of the wheel being caused only through the lateral friction or, much as in the case of the four-wheel devices, about an oblique axis as described in U.S. Pat. No. 3,501,162, in which case the steering is achieved jointly by the inclination of the foot and the frictional force. In another well known design, for reducing the effect of friction on the steering of the wheel an element is provided near ground level. This however creates a risk of striking irregularities in the ground and consequent loss of balance.

In the case of the roller skate with a number of wheels arranged in tandem the edge of the skate is replaced by the frictional force occurring between wheel and ground. The force is therefore of appreciable size, which on the one hand has an advantageous effect as it ensures stability, but on the other hand, because it influences the steering of the wheels, entails the following drawbacks:

The fixed lateral support is reduced because the wheels slew and the roller skate rolls forwards or backwards.

The efficiency at starting is less than is desired because the lateral support is not sufficient.

Between the pivoting of the wheel and the movement of the foot there is a different relationship as compared with ice skating, so that these contrivances are not very suitable as training appliances for ice.

The degree of wheel slewing depends largely on the material of the wheel and the ground, i.e., on the coefficient of friction, so that the steerability of the roller skate is altered accordingly.

The curve of travel is not closely related to the posture of the foot whereby sliding friction occurs, which in its turn produces rapid wear of the wheels and slow rolling, the foot muscles being strained in a manner contrary to Nature.

A sudden variation in the frictional force, for instance owing to a small pebble lying in front of the wheel, can result in a loss of balance.

The present invention is based on the task of creating a roller skate of the said type which, in contrast to other such roller skates, can be steered to a preponderant extent by shift of weight and the inclination of the stressed foot and only slightly, or not at all, through frictional forces between wheel and ground, so that less sensitivity to unevennesses of the ground is obtained, which inter alia improves its safety.

The invention consists broadly in a multi-wheel roller skate having at least one steerable wheel pivoting about a steering axis, and comprising a frame which can be inclined or tilted laterally with respect to the ground, and a steering element controlling the steering movement of the wheel and pivotally connected to the frame on a tilting axis which is inclined in relation to the ground surface as defined by the contact points with the wheels, at an angle $\alpha$, where $0 \leqq \alpha < \pi/2$.

Other desirable features of the invention will be apparent from the following description, drawings and claims.

The invention may be performed in various ways and several embodiments of the invention will now be described by way of example, with reference to the accompanying drawings, in which.

Figure 5:
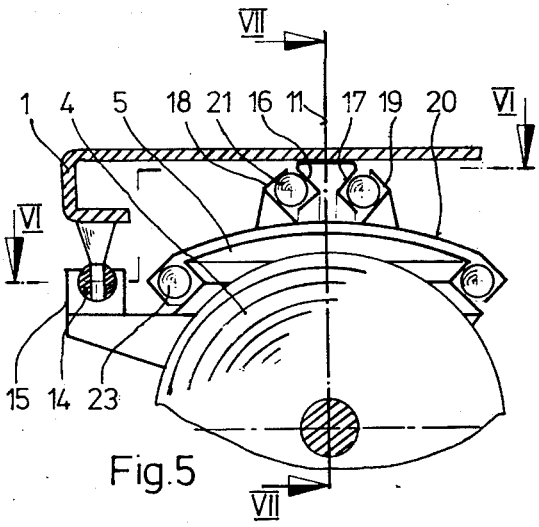
Figure 6:
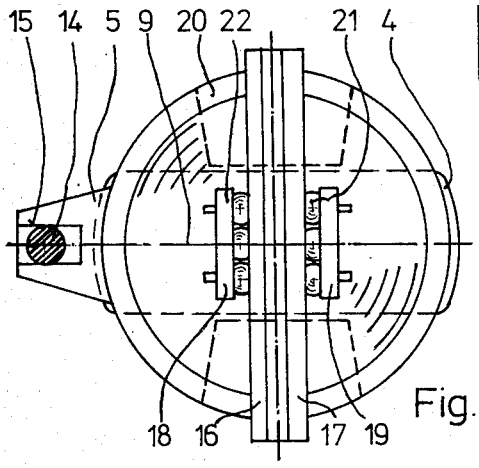
Figure 7:
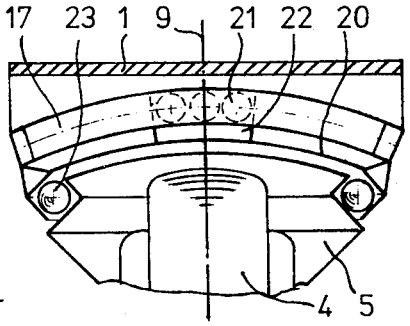
Figure 4:
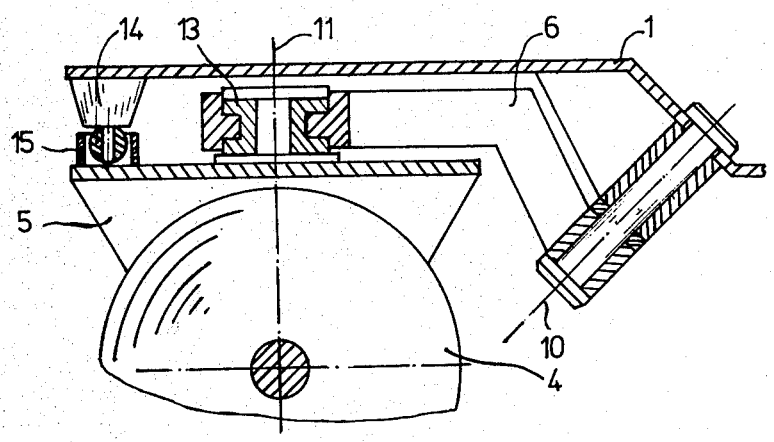
Figure 8:
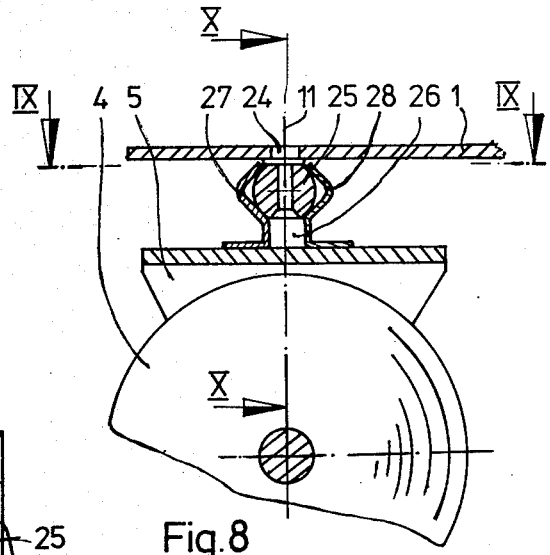
Figure 9:
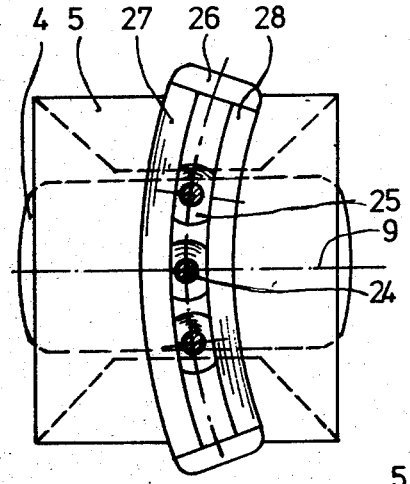
Figure 10:
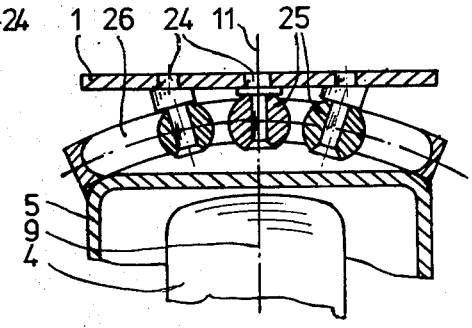

FIG. 4 is a longitudinal section through the rear portion of the roller skate on a larger scale, FIG. 5 is a longitudinal section through a modified form of rear wheel bearing for a roller skate according to the invention, FIGS. 6 and 7 are cross-sections through the rear wheel mounting on the lines VI—VI and VII—VII in FIG. 5, FIG. 8 is a longitudinal section through a further form of rear wheel bearing for a roller skate according to the invention, FIGS. 9 and 10 are cross-sections on the lines IX—IX and X—X in FIG. 8.

Figure 1:
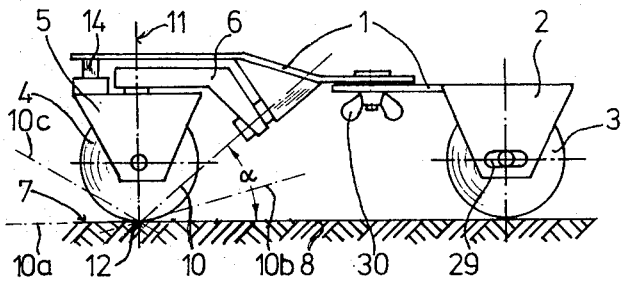
FIG. 1 is a side view of a roller skate according to the invention.
Figure 2:
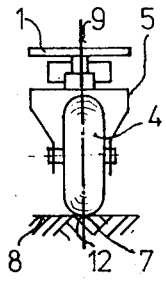
FIG. 2 is a rear view thereof.

First of all the principle axes, planes and components of the invention will be explained by reference to FIGS. 1 and 2. To a frame 1 is attached a wheel yoke 2 in which is mounted a front non-steerable wheel 3. As shown in FIG. 1 the rear wheel 4 is the steerable wheel, which is mounted in a wheel yoke 5 so as to be rotatable about its running axis, i.e., the axis of the wheel. Between the frame 1 and the rear wheel yoke 5 is a steering device, comprising a connecting piece 6. The roller skate can tilt about its momentary tilting axis 7 on the ground 8, which latter forms the lower plane of contact and movement for the two wheels. The momentary tilting axis 7 is produced by the line of intersection of the ground plane 8 with the longitudinal plane of symmetry 9 of the roller skate.

The frame 1 and the connecting piece 6 are pivotable in relation to one another about an oblique tilting axis 10 on the frame; similarly the wheel yoke 5 can pivot in relation to the connecting piece 6 about a vertical pivoting or slewing axis 11 for the wheel. In FIG. 1 the two axes are represented in such a way that for the sake of simplicity they lie respectively in the plane of longitudinal symmetry 9, and pass through the base contact point 12 of the wheel 4. The latter can be defined as the point of contact of the steered wheel 4 with the ground 8. In practice it is not, of course, a point of contact, but a contact surface, or strictly speaking a line contact. However it will be understood that the expression "point contact" is to be interpreted accordingly.

The steering axis 11 forms with the ground 8 an acute angle which is preferably greater than 45° and is advantageously a right angle, as shown in FIG. 1. In this way kinematic effects are immaterial to wheel steering, so that the appliance displays identical steering behaviour when travelling forward and backward. The tilting axis 10 of the frame 1 also forms with the ground 8 an acute angle, which is preferably less than 45° and in the most favourable case is nil, i.e., it runs along the ground, as illustrated by position 10*a*. In the case of an acute angle, the portion of the axis 10 above the ground 8 can vary as shown by the position 10*b* in the plane of the mean axis of symmetry 9 between the wheels; this portion of the axis can, however, also lie outside the wheels as indicated at item 10*c*.

Figure 3:
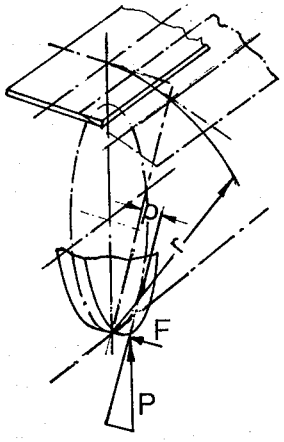
FIG. 3 is a diagram of forces exerted at the rear wheel.

As may be seen from FIG. 3 the steerable wheel 4 transfers the load from the weight of the user's body to the ground 8 at its base contact point 12: here there occurs both a reaction force P and a laterally directed frictional force F. In contrast with prior roller skates, in the roller skate according to the invention the frictional force has less effect. In these examples this effect is substantially eliminated since the force F on the plane of the ground 8 points in the direction of the steering axis 11 and/or the frame tilting axis 10, and intersects both these axes at a common intersection point 12 on the ground plane, i.e., it has no moment arm and therefore produces no torque about these axes; it does not therefore tilt the frame 1 about its tilting axis 10 nor does it pivot the steerable wheel 4 about its steering axis 11. This effect is obtained by the pivoting axis 11 meeting the apex of the acute angle formed by the tilting axis 10 and the ground 8 at the point of contact of the steerable wheel with the ground, i.e., at the base point 12.

In prior roller skates the effect of this frictional force F, which is effectively eliminated according to the present invention, was considerable because a tandem wheel arrangement requires a fixed lateral support that is ensured by this force and can thus attain 50 to 80% of the reaction force P. In the present invention on the other hand, as shown in FIG. 1, the wheel steering effect is achieved by a smaller force, because to execute a curve, the roller skater inclines his body, i.e., the load otherwise distributed evenly along the line of contact 12 is no longer symmetrical with the longitudinal plane of symmetry 9, and the reaction force P shifts away from this plane and thus generates a moment arm in relation to the tilting axis 10, i.e., it produces a torque.

When therefore the frame 1 tilts, this arrangement causes pivoting of the steerable wheel 4 about its steering axis 11. The position of the reaction force to the weight of the body, and its displacement from the plane of longitudinal summary 9, i.e., the moment arm and the size of the torque, depends on the spatial position of the centre of gravity of the body, i.e., on the degree of inclination of body and feet, while the size of the reaction force is dependent on all forces acting on the centre of gravity of the body, i.e., on the dynamic state of the centre of gravity. The steering of the wheel is thus determined by the change of position of the user's centre of gravity and by the forces acting on it, irrespective of the frictional forces. It will be appreciated that the wheel-pivoting action of the reaction force P depends on the angles of inclination of the pivoting axis 11 and the tilting axis 10 in relation to the ground 8. The effect is greatest when the pivoting axis 11 is at right angles to the ground 8 and the tilting axis 10 lies along the latter.

This arrangement provides many advantages. Thus for instance the lateral support is more rigid, since the wheel does not pivot merely under the effect of friction. For this reason the efficiency of the drive is better. Moreover, between the wheel steering and the base or position of the body there is a relationship which is independent of external circumstances, and this represents an extraordinarily important advantages in the case of a sports toy.

FIG. 4 illustrates an embodiment of the articulated connection between the frame 1 and the steerable wheel 4. The latter is arranged to be rotatable in the wheel yoke 5, about its running axis. The wheel yoke 5 is connected to the connecting piece 6, which in the present example is a bent arm, via a bearing 13 located on the steering axis 11, while the frame 1 is mounted tiltably about the frame tilting axis 10 in relation to the connecting piece 6. A ball-type joint 14, or other journal, attached to the frame 1 and lying within the plane of longitudinal symmetry 9, moves in a guide path or race 15, attached to the wheel yoke 5, and the parts 14 and 15 form a hinged connection. When the frame 1 pivots about the tilting axis 10, the pin of the joint 14 emberges from the longitudinal plane of symmetry 9 and with the aid of the guide race pivots the wheel yoke 5 about the pivoting axis 11. The wheel pivoting angle obtained for a corresponding angle of tilt of the frame can be determined by the ratio of the kinematic torque arms.

The bearing 13 can be a ball or plastic bushing mounting, or even a rubber ring which acts as a torsion spring and contributes to pivoting the steered wheel 4 in the unloaded state back into the central position corresponding to rectilinear forward travel. In other cases a spring, advantageously with an adjustable spring force, can be inserted between any two of the parts, pivotable or movable in relation to one another. The frame slewing axis 10 in FIG. 1 can also be moved into the position 10c when the connecting piece 6 is formed as a fork arm, so that between the two shanks of the fork sufficient space remains for the movement of the pin or joint 14 in the race 15. In this case either on the under side of the connecting piece, or on the under side of the frame 1 it is of advantage to provide a braking device which the user causes to act by raising the front part of his foot; when the steered wheel is arranged near the front of the foot, such a device can act as a push-off device to assist in starting. It will be understood that these braking or push-off devices can also be mounted on the further embodiments to be described below.

The example of the invention illustrated in FIGS. 5, 6 and 7 displays a particularly advantageous arrangement of axes. In this case guideways 16,17 attached rigidly to the frame 1 form arcuate races 18,19. The movement of the frame 1 is determined by the plane of operation of the races 18,19 which in the present instance runs at right angles to the ground 8 and to the plane of symmetry 9 and contains the pivoting axis 11. In this way it is easy to ensure that the articulating movement of the frame 1 takes place along the arc of a circle with the base point 12 as the centre of the circle. In other words the tilting axis lies horizontal at ground level. In principle, a different centre point and also a different type of curve are possible, but in the manner described the best effect can be obtained in the simplest way.

The steering device 20 is mounted on the frame 1 by means of a ball cage 22 containing balls 21 running in the guideways 16,17, and is connected by a ball race 23 to the wheel yoke 5. Furthermore, the frame 1 is connected by the articulated connection 14,15 with the wheel yoke 5, so that on movement of the frame 1 in the races 18,19, i.e., when it is tilted about the tilting axis 10, the wheel yoke 5, with the steered wheel 4, is slewed by the race or guide groove 15 about the steering axis 11. Of course the guideways 16,17 can also be attached to the steering device 20 and accordingly the ball cage 22 to the frame 1. In this way the device 20 becomes a steering device with two guide paths or races.

A further example of the invention is illustrated in FIGS. 8, 9 and 10. On the frame 1, symmetrical with the longitudinal plane of symmetry 9, journals 24 are attached, about which rotate rollers 25 which engage with arcuate shaped guide elements 27,28 secured to the wheel yoke 5, and forming a race 26. The steering device is in this embodiment the race 26, whose operating plane is arranged functionally in such a way that both the position of the frame slewing axis 10 and the wheel steering axis 11 are determined thereby. This operating plane can, for instance, be inclined at an acute angle to the ground 8, the race 26 being in the form of an arc of a circle, which is curved both as seen in plan in FIG. 9 and in cross-section in FIG. 10. In this case the operating plane determines the pivoting axis 11 and the arc of the circle the pivoting axis 10. Of course, a reverse construction of the roller skate is feasible and moreover the race or guide path 26 can be mounted on the frame 1, and the journals 24 and the rollers 25 on the wheel yoke 5.

When the frame 1 is tilted, the wheel yoke 5 pivots under the action of the race 26. The extent of tilting of the frame and the pivoting of the wheel can be determined by the shape of the race 26 and by the angle of inclination of its operating plane. In this example, the hinged connection 14,15 can be omitted, whereby the design becomes simpler; the best positioning of the axes for furnishing the best steering force cannot however be obtained in this way.

In the first embodiment, pivotal axes are formed by axles or pins, in the second and third examples by races or guide paths. A combination of these elements is, however, possible. Moreover, the rolling elements can be replaced by sliding or elastically deforming pairs of elements, relying on internal frictional conditions of the device. Between the various parts which move in relation to one another in the manner described, it is possible to fit springs with compressive, bending or torsional stress (e.g. at the bearing 13) and if necessary adjustable spring force, assisting the return of the unstressed components to their original positions and also capable of determining the maximum value of these movements. The use of adjustable spring elements makes it possible to match the relative movements of the kinematic parts to the size of the reaction force, i.e., of the weight of the user's body.

The roller skate can be designed in such a way that both or all its wheels are steerable, but it is feasible to have only one steerable wheel, preferably a steerable rear wheel. It is an advantage for the wheel which is not steered to be mounted in a horizontal longitudinal slot 29 (see FIG. 1) so that the user can adjust its position in accordance with his balance and stability needs.

The frame 1 can be designed in different ways. It can be attached in any known way to the user's shoe, it can be "custom" made to measure, or be adjustable in length, the latter case being illustrated in FIG. 1 by an adjustment screw 30. When the central portion of the frame is designed with considerable length, the wheels can be arranged inside this sole zone producing a sporting appliance with steerable wheel or wheels suitable for imitating ski-running movements, and the advantages according to the invention are also transferred to this domain. The front and rear parts of the frame 1 can also be attached as separate units, independently of one another, to the user's shoe; they can also form an organic unit with the sole of the shoe.

The running surface of the wheels can be cylindrical but a more harmonic movement with rather less steering power is obtained by a bearing surface profile whose curve consists of arcs of circles with different radii. In the case of a non-steerable wheel, the curve of the bearing surface profile is for preference adapted to the position of the frame tilting axle 10.

Wheel steering by means of the described steering devices makes it possible to create a simple, very precise apparatus, and when the tilting axis of the frame is located outside the wheel zone, the possibility is afforded of fitting a braking or starting device.

The bearing race or guide path connections allow the tilting axis of the frame to run on or parallel with the ground whereby the steering effect of the reaction force can be suitably utilised. A further advantage resides in the fact that it is not necessary here to arrange any component near the ground, so that the roller skate can be used on roadways and pavements without the risk of striking the ground. The use of bearing races or guide paths with rollers is more accurate and generates less internal friction. The use of sliding elements is simpler, while the elastically deformable elements furnish the most greatly simplified apparatus, but the practical utility value of the latter is somewhat reduced.

If both or all of the wheels on the skate are made steerable, skating curves can be followed very accurately, whereby an appliance is produced which also meets the demands of trick skating; on the other hand, roller skates with signal wheel steering are suitable for faithful simulation of the movements of an ice hockey game, which are often interrupted by severe braking. As the unsteered front wheel is mounted in a slot the user can shift the wheel into his weight line and still further enhance the feeling of stability.

The well-known adjustability in length likewise presents obvious advantages; it seems still more advantageous to arrange the front and the rear wheels separately on a central flexible sole, whereby natural movement and posture of the foot are rendered possible.

A roller skate according to the invention meets the high demands made on sporting gear and can become a useful training appliance for winter sports, as it stresses accurately the same muscles that are used for instance on ice. Moreover, it widens the possibilities of movement and contributes to the healthy utilisation of leisure time, which is becoming ever longer, even where no costly synthetic ice is available.

We claim:

1. A multi-wheel in-line roller skate, having at least one steerable wheel pivoting about a steering axis, and comprising a frame which can be inclined or tilted laterally with respect to the ground, and a steering mechanism controlling the steering movements of the steerable wheel, and pivotally connected to the frame on a tilting axis which is inclined in relation to the ground surface as defined by the contact points with the wheels, at an angle $\alpha$ where $0 \leqq < \pi/2$, the steerable wheel also being mounted for pivotal movement relative to the frame about a vertical steering axis, and in which both the tilting axis and the steering axis intersect the ground substantially at the point of contact between the steering wheel and the ground.

2. A roller skate according to claim 1, in which the steering mechanism includes a connecting piece pivotably connected to the frame about the said tilting axis, and carrying a wheel yoke which is rotatable relative to the connecting piece about the said vertical pivoting steering axis, and carries said steerable wheel, the wheel yoke being additionally connected to the frame by a hinged connection displaced from the said steering axis causing it to pivot about the steering axis.

3. A roller skate according to claim 1, and a journal bearing which defines the tilting axis and which is located between two wheels of the skate.

4. A roller skate according to claim 2, and a journal bearing which defines the tilting axis and which is on the side of the steerable wheel remote from the other wheel.

5. A roller skate according to claim 1, in which the steering mechanism comprises a connecting part having an arcuate guide bearing, the said part being pivotable relative to the frame about the tilting axis, and also pivoted about the steering axis relative to a wheel yoke carrying the steerable wheel, the yoke being connected also to the frame by a hinged connection displaced from the steering axis causing the wheel to pivot about the steering axis.

6. A roller skate according to claim 1, in which the steering mechanism includes an element having an arcuate guide bearing, lying in the plane perpendicular to the tilting axis, and rigidly attached to a wheel yoke for the steerable wheel, the plane of the bearing forming an arcuate angle with the plane of the ground or the longitudinal plane of symmetry of the skate.

7. A roller skate according to claim 1, including an adjustable spring between two of the three main parts, namely the frame, the steering element and the wheel yoke.

* * * * *

UNITED STATES PATENT AND TRADEMARK OFFICE

CERTIFICATE OF CORRECTION

PATENT NO. : 4,132,425

DATED : January 2, 1979

INVENTOR(S) : Aladar LEHNER et al.

It is certified that error appears in the above-identified patent and that said Letters Patent are hereby corrected as shown below:

IN THE CLAIMS:

Claim 1, line 9, change "$0 \leqq < \pi/2$" to --$0 \leqq \alpha < \pi/2$--.

Signed and Sealed this

*Twenty-third* Day of *December 1980*

[SEAL]

*Attest:*

SIDNEY A. DIAMOND

*Attesting Officer*

*Commissioner of Patents and Trademarks*